252-99
9/7/82
XR 4,348,293

United States Patent [19]

Clarke et al.

[11] 4,348,293

[45] Sep. 7, 1982

[54] WATER-INSOLUBLE, WATER-PERMEABLE BAG HAVING A WATER-SOLUBLE OR WATER-DISPERSABLE PROTECTIVE LAYER AND CONTAINING A PARTICULATE DETERGENT COMPOSITION

[75] Inventors: David E. Clarke; James F. Davies; John B. Tune, all of Merseyside, England

[73] Assignee: Lever Brothers Company, New York, N.Y.

[21] Appl. No.: 198,016

[22] PCT Filed: Nov. 16, 1979

[86] PCT No.: PCT/GB79/00192

§ 371 Date: Jul. 14, 1980

§ 102(e) Date: Jul. 14, 1980

[87] PCT Pub. No.: WO80/01078

PCT Pub. Date: May 29, 1980

[30] Foreign Application Priority Data

Nov. 17, 1978 [GB] United Kingdom ..... 45076/78
Nov. 17, 1978 [GB] United Kingdom ..... 45078/78

[51] Int. Cl.[3] ..... C11D 17/00; C11D 7/54

[52] U.S. Cl. ..... 252/90; 252/92; 252/94; 252/95; 252/99; 252/174

[58] Field of Search ..... 252/90, 92, 93, , 174; 150/3; 206/0.5, 624; 220/DIG. 30

[56] References Cited

U.S. PATENT DOCUMENTS

| | | | |
|---|---|---|---|
| 2,470,851 | 5/1949 | Hermanson | 206/0.5 |
| 3,322,674 | 5/1967 | Friedman | 252/90 |
| 3,549,381 | 12/1970 | Kisinger | 99/77.1 |
| 3,661,695 | 5/1972 | Berliner | 428/351 X |
| 3,694,364 | 9/1972 | Edwards | 252/90 |
| 3,859,125 | 1/1975 | Miller | 128/287 X |
| 4,108,600 | 8/1978 | Wong | 8/137 |
| 4,170,565 | 10/1979 | Flesher | 252/93 |
| 4,188,304 | 2/1980 | Clarke | 252/93 |
| 4,234,442 | 11/1980 | Cornelissens | 252/90 |
| 4,295,850 | 10/1981 | Häberli et al. | 8/524 |

FOREIGN PATENT DOCUMENTS

| | | |
|---|---|---|
| 901244 | 5/1972 | Canada . |
| 31346 | 11/1933 | Netherlands . |
| 950256 | 2/1964 | United Kingdom . |
| 961821 | 6/1964 | United Kingdom . |
| 1013014 | 12/1965 | United Kingdom . |
| 1164141 | 9/1969 | United Kingdom . |
| 1298454 | 12/1972 | United Kingdom . |

*Primary Examiner*—P. E. Willis, Jr.
*Attorney, Agent, or Firm*—James J. Farrell

[57] ABSTRACT

A detergent product comprises a water-insoluble, water-permeable bag containing a particulate detergent composition, the bag material having a water-soluble or removable water-insoluble layer to protect the bag material from the composition and to reduce dusting. The protective layer may be coated on or impregnated into the bag material or may form a continuous layer laminated to the inside of the bag material or may be in the form of a separate inner bag. The water-soluble material may be soluble polyvinyl alcohol, polyethylene glycol, polysaccharide, alkali metal silicate, soap, nonionic detergent, gelatine, salts or esters of alginic acid. The removable water-insoluble material may be a silicone, a fatty acid, a water-insoluble cationic fabric softener, polyvinylacetate, insoluble polyvinyl alcohol, clay, zeolite, calcite, silica, titania or a wax. The bag material may be paper and/or plastics material such as polypropylene. The detergent composition is a fully formulated composition or other fabric treatment material.

17 Claims, No Drawings

WATER-INSOLUBLE, WATER-PERMEABLE BAG HAVING A WATER-SOLUBLE OR WATER-DISPERSABLE PROTECTIVE LAYER AND CONTAINING A PARTICULATE DETERGENT COMPOSITION

TECHNICAL FIELD

This invention relates to detergent products which are suitable for fabric washing and which contain detergent compositions in particulate form.

BACKGROUND ART

Although the marketing of particulate detergent compositions packaged in cartons is common practice, this imposes constraints both on their formulation and methods of production. For example the compositions must be free flowing and have an attractive appearance to the consumer, and the ingredients should not segregate during transport and storage. The products must also be safe, both for contact with the skin and in the event of accidental ingestion; in particular, the compositions should not contain too high a level of alkaline materials, although alkalinity is beneficial for detergent properties.

When using washing machines which have a rotating drum in which the fabrics are placed, there can also be substantial losses of conventionally dosed detergent powder by retention in the dispenser and by its accumulation in the dead spaces beneath the drum, such as the drain hose.

It has been proposed previously to market powdered detergent compositions in packages, each of which contain suitable amounts of the detergent powders for individual washes under standard washing conditions. In particular, from British Pat. No. 1,298,454 and U.S. Pat. No. 3,198,740 the detergent powders can be contained within bags of water-permeable or water-soluble materials, such as soluble polyvinyl alcohol, but such packages have not yet met with much commercial success. One of the reasons for this, in the case of water-soluble bags, is the sensitivity to moisture which leads to storage difficulties. In the case of water-permeable materials, one of the reasons is the difficulty of making the bags sufficiently permeable to water in use so that the contents of the bags are rapidly dissolved out into the wash liquor, and yet reducing dusting of the detergent powder out of the bags during transport and manual handling to an acceptable level. Also, some detergent compositions, in particular bleach-containing compositions, cause inacceptable degradation of the bag material.

Canadian Patent No. 901 244 discloses a bag for insecticide powders, the bag being formed of a water-soluble film reinforced with a net of water-insoluble thermoplastic material.

DISCLOSURE OF THE INVENTION

According to the invention there is provided a detergent product comprising a particulate detergent composition contained within a closed water-insoluble, water-permeable bag formed of sheet material, a layer of water-soluble or removable water-insoluble material protecting the bag material from the detergent composition. By using this form of construction for the bag, it is possible to protect the bag material during storage and to prevent undue dusting of the composition through the bags and yet the porosity of the water-insoluble sheet material can be high enough to quickly release all of the contents of the bag as soon as the water-soluble layer is dissolved or the water-insoluble layer is removed in use. It is possible to use a relatively open water-insoluble sheet material for the bag, as dusting of the detergent composition through the pores is reduced or prevented by the water-soluble or removable water-insoluble layer. Moreover, it is possible to form the bags of material which can be readily heat-sealed, which facilitates manufacture.

BEST MODE OF CARRYING OUT THE INVENTION

The bags are formed with a water-insoluble sheet material which can be formed of paper or of woven, knitted or non-woven fabric, provided that each of these should be water-insoluble and water-permeable. If the bags are to be used for detergent powder which contains a bleaching agent, for example sodium perborate or sodium percarbonate, it is also desirable to form the bags of sheet material made from oxidation-resistant fibres.

A suitable sheet material for forming the bags is water-permeable paper or non-woven fabric of high wet strength, weighing about 5 to 100, preferably 10 to 60 $g/m^2$, especially about 15 to 40 $g/m^2$, such as is commonly used for packaging beverage powders and other foodstuffs, and suitable sheet materials of this type are commercially available for example from J R Crompton Bros Ltd of Bury, England. The fibres preferably used for the sheet materials may be of natural or synthetic origin and may be used alone or in admixture, for example polyamide, polyester, polyacrylic, cellulose acetate, polyethylene, polypropylene, PVC, PVdC (polyvinylidene chloride) or cellulosic fibres. If some cellulose pulp is used, it may be desirable to include a proportion of long fibres such as Manila hemp, in order to improve the strength of the sheet material, and pliability, and reducing stiffness, thereby giving the material a fabric-like appearance, and a binder may be necessary for increasing wet strength. It is preferred to include at least a proportion of thermoplastic fibres, for example polypropylene fibres for increasing resistance to chemical attack by any of the ingredients of the detergent compositions.

The layer of water-soluble or water-insoluble material may be either a continuous layer or sheet of such material or a discontinuous layer. In the former case the continuous layer can be attached, i.e. laminated to the water-insoluble sheet material, inside the sheet material of the bags, or it may be separate from the sheet material, so forming one bag inside the other. Particularly in the laminated form of construction of the bags using a continuous layer or sheet of a water-soluble material, it is preferred to use a synthetic water-soluble polymer (homopolymer or copolymer) such as soluble polyvinyl alcohol or polyethylene glycol.

Particularly if a water-soluble material is applied as a discontinuous coating on the water-insoluble sheet material, a wider variety of water-soluble materials can be used to give a protective effect, for example polysaccharides such as starch or dextrin, alkali metal silicate, soap, gelatine, salts and esters of alginic acid, salts and esters of methyl cellulose, carboxymethyl cellulose and water-soluble cationic fabric softeners or water-soluble synthetic polymers such as water-soluble polyvinyl alcohol, polyethylene glycol or nonionic detergent compounds.

The water-insoluble sheet material may alternatively be treated with a removable water-insoluble protecting agent. This can either be a non-volatile liquid or solid material, of organic or inorganic nature, provided that it is substantially inert to the detergent system and can be applied to the sheet material, before or after forming the bags, to give a protective effect. The removable water-insoluble protecting agent should be water dispersible to that, in use, it is quickly removed from the bag material, thereby opening up the pores in the bag material enabling fast dissolution and dispersion of the detergent composition in the wash liquor. In this specification the term "removable water-insoluble protecting agent" is to be construed accordingly. Specific protecting agents which may be mentioned are waxes which are solid or highly viscous liquids at room temperature, and which can be applied to the sheet material to form a protective coating over the fibrous surface. Such materials are dispersible in detergent wash liquor, especially at elevated temperatures where they may then also exert a beneficial lather controlling effect. The waxes are well known commercially available substances. The waxes can be of natural or synthetic origin and optionally halogenated to improve their chemical stability.

Alternative protecting agents are silicones, fatty acids, water-insoluble cationic fabric softeners, polymeric materials such as polyvinylacetate, insoluble polyvinyl alcohol and insoluble finely divided inorganic material, such as natural clays or synthetic colloidal filler substances such as zeolite, calcite, silica or titania, which can be applied to the sheet material so as to coat the fibres and to some extent temporarily close the pores of the sheet material until its addition to water. Preferably, clays are used for this purpose, for example kaolin, attapulgite, Fuller's Earth, bentonite, montmorillonite and smectite clays. Some of the clays, especially the smectite clays, have a fabric softening action in the wash after their removal from the bags in the use.

Mixture of protecting agents may be used, especially mixtures of the liquid or waxy solids with the finely divided inorganic materials. The former can thereby assist the adhesion of the latter to the sheet material to enhance the protective effect.

In the case of the coating material being a wax, it is preferably applied to the sheet material before it is formed into the bags by passing the sheet material through a bath of wax or by spraying on the wax, either as a hot melt or preferably in solution or as an aqueous emulsion. The gravure printing process used for waxing paper, such as operated by George Makin Limited, Manchester, England, is suitable for such process. The water or organic solvent used to apply the wax in this way is later removed, for example by heating, and this facilitates the more uniform application of the wax to the sheet material at acceptable levels. The particulate inorganic protecting agents such as clays should be applied by coating, impregnating, padding or spraying on an aqueous organic solvent suspension, or preferably in admixture with the liquid or waxy solid materials. In the case of a removable water-insoluble protective agent, the amount thereof used is advantageously about 0.5% to about 50%, preferably about 1–20% by weight based on the sheet material. These treatments also minimise dusting, and protect the bag material from attack by the detergent compositions. If the layer of water-soluble or removable water-insoluble material is discontinuous it is preferably attached for support to the water-insoluble sheet material and may be applied thereto by impregnation, saturation or coating.

When a sheet material is used coated with a discontinuous water-soluble or removable water-insoluble layer, the pore size of the coated sheet material should be such that there is no excessive dusting of the detergent composition through the material of the bags in the dry state, but preferably not so small that water cannot pass readily through the material forming the bags to disperse and dissolve the contents when the product is used. The preferred level of coating is thus a function of the pore size distribution of the uncoated bag material, the particle size distribution of the detergent composition and the acceptable degree of dusting. For optimum properties the degree of dusting is such that no more than about 5%, by weight, preferably no more than about 1%, of the detergent composition particles can pass through the coated sheet material. With very fine powders, for example made by dry mixing, the maximum pore size of the treated sheet material must be very small, preferably so as to retain only detergent particles greater than about 20 microns. With coarser grained detergent compositions the maximum pore size of the treated sheet material may be larger so as to retain detergent particles greater than about 100 microns, e.g. about 500 up to about 1000 microns, as appropriate. It may be noted that larger pore sizes are generally better for dissolving powder quickly, but this puts more constraints on the powder processing techniques which can be used in order to avoid excessive dusting.

Where the bag material is water-permeable paper or non-woven fabric of high wet strength weighing about 10 to about 60 $g/m^2$, or other material having a similar pore size distribution, a coating thickness of from about 15 $m/g^2$ to about 45 $g/m^2$, advantageously about 30 $g/m^2$, is preferred.

The bags can be formed from a single folded sheet formed into a tubular section, or from two sheets of the material bonded together at the edges. For example, the bags can be sachets formed from single folded sheets and sealed on three sides or from two sheets sealed on four sides for the preferred rectangular shape. Alternatively, the sheets can be folded like envelopes with overlapping flaps to be sealed. Other bag shapes or constructions, for example circular cushion shaped sachets or of tetrahedron form, may be used if desired. The bags may also be reinforced, if desired, to decrease the risk of leakage during handling, for example by adding an extra thickness of the sheet material where the bags are expected to be held or passing completely round the bags to help support the weight of detergent powder.

The bags may be sealed by heat-sealing, cold pressure sealing or with an adhesive. In the case of heat-sealing the bag material should contain at least a minor proportion of a thermoplastic material, such as polyproplene. Alternatively, the bag material may be coated with a layer of heat-sealable or pressure sealable material such as a vinyl acetate/vinyl chloride copolymer.

To increase the rate of dispersion and dissolution of the detergent composition in the wash liquor, the bag may be adapted to open in the wash, for example by bursting at a weak seal or along a perforation line, by the disintegration of the bag material itself or by at least one of the seals being formed with a water-soluble adhesive that will dissolve in the wash liquor. The invention is also applicable to bags that do not open in the wash.

Any detergent composition in particulate form can be packaged to advantage in the product of the invention. As an alternative to a fully formulated detergent composition (that is a composition containing at least a surfactant and a builder) the bags may contain any one or more of the following fabric treatment materials: bleaches such as sodium perborate; bleach precursors such as tetraacetylethylene diamine (TAED); fabric softeners such as quaternary ammonium compounds, starch, perfumes, anti-bacterial agents; stain removing agents and the like. It can be of particular advantage to add fabric treatment materials to the wash in a bag while dosing a fully formulated detergent composition in a conventional manner, where the incorporation of the fabric treatment material in the fully formulated detergent composition may otherwise be difficult. This is of particular importance in the case of perfumes, bleaches, bleach precursors and cationic fabric softening agents.

The fully formulated compositions which can be packaged to advantage in the products of the invention are amply described in the literature, for example in "Surface Active Agents and Detergents", Volumes I and II, By Schwartz, Perry and Berch.

However, the products of the invention are advantageously used for detergents powders containing insoluble ingredients. Specific examples of such ingredients include finely divided calcium carbonate, the use of which is described in UK Pat. No. 1,437,950, and sodium aluminosilicate ion-exchange materials as described in UK Pat. Nos. 1,429,143, 1,473,201 and 1,473,202.

It is also advantageous to use the products of this invention with detergent compositions containing bleach systems, particularly containing TAED and sodium perborate.

In addition, the detergent products of the invention are particularly suited for detergent compositions of relatively high bulk density, i.e. over about 0.5 g/cc, preferably about 0.6 to 0.8 g/cc, up to a maximum of about 1 g/cc, above which there tends to be a reduction in the rate of water solubility or dispersibility. The use of high bulk density compositions makes it possible to decrease the size of the detergent bags whilst still containing enough particulate detergent composition to be fully effective during use. This also enables the use of simple processing techniques for the production of the detergent compositions themselves, e.g. granulation or dry mixing instead of traditional spray drying techniques.

If desired, the sheet material used to form the bag can be marked or tagged so that it can be easily recognised amongst the washed fabrics, for example the material may be printed with a simulated fabric patterns such as check or gingham. It can then either be discarded, or, if desired, it may be constructed of a suitable material to provide it with a secondary use, for example as a cleaning cloth.

If desired, the bags can be formed with more than one separate compartment containing different detergent ingredients or the bags may be formed in a conjoined manner, for example in a strip to facilitate dosing of different numbers of the bags as appropriate for the wash conditions. The use of multi-compartment bags facilitates the use of detergent ingredients which would otherwise interact with other ingredients in detergent compositions, whilst avoiding encapsulation or other treatment to prevent contact between such ingredients in a single composition.

For example one compartment may contain a fully formulated detergent free of bleach while a second compartment may contain the bleach. A third compartment may contain a fabric softener.

The invention is illustrated by reference to the following Examples in which parts and percentages are by weight except where otherwise indicated.

EXAMPLES 1 to 3

Bags for detergent compositions were constructed with a laminated construction, having a water-soluble polyvinyl alcohol sheet (HI-SELON C) of thickness 0.0015 inch inside water-insoluble sheet materials as follows:

EXAMPLE 1—Manila hemp with viscose wet strength agent (21 g/m$^2$).

EXAMPLE 2—Manila hemp fibres treated with Kymene/polymeric wet strength agent and with a 20:80 vinyl acetate/vinyl chloride copolymer as heat sealing agent. Weight 27 g/m$^2$.

EXAMPLE 3—Highly porous polypropylene spunbonded non-woven fabric. Weight 10 g/m$^2$.

All three types of bags were made by folding the superimposed water-soluble and water-insoluble sheet materials (former inside) and then heat-sealing along the two opposing edges. 84 g of a detergent composition of high bulk density (0.68 g/cc) prepared by a granulation process as described in Belgian Pat. No. 867 038 (U.S. application Ser. No. 905,681) to the formulation below was then added to the bags which were heat-sealed along the open edges to form sachets (4½"×4½").

| Ingredient | % |
|---|---|
| Nonionic detergent surfactant | 14.0 |
| Sodium carbonate | 34.0 |
| Calcium carbonate (80 m$^2$/g) | 18.0 |
| Sodium perborate | 25.0 |
| Sodium carboxymethylcellulose | 3.3 |
| Fluorescent agent, perfume | 1.0 |
| Water | 4.7 |

The bags were found to exhibit improved storage properties under high relative humidities and to give good detergent properties in use. The bags of Example 1 and 2 opened within 2 minutes in the wash, the first by dissolving the polyvinyl alcohol sheet which also formed the seal, and in Example 2 by bursting the bags along a seam. The bags of Example 3 did not open in the wash but liberated their contents through the highly porous polypropylene sheet material after dissolution of the polyvinyl alcohol sheet, under the vigorous agitation in the washing machines.

EXAMPLE 4

Sheets of Manila hemp with viscose wet strength agent (21 g/m$^2$) were treated with an even coating of a water-insoluble polyvinyl acetate homopolymer obtained from National Adhesives and Resins Limited, Slough, England. The coating material, in the form of an aqueous dispersion, was spread evenly on one side of each sheet using a cylindrical metal rod. The treated sheets were dried in air. On examination it appeared that the coating had penetrated the paper. Bags were prepared from these treated sheets by heat sealing, the bags containing 80 g of a carbonate/calcite powder as used in Examples 1 to 3. The bags were 4½"×4½". None of the bags gave unacceptable dusting during handling. These bags were examined to determine whether the powder was released into the drum of a front loading automatic washing machine after agitation for 2 minutes. It was found that bags having a coating of 19 or 22 g/m$^2$ were open and empty after 2 minutes.

EXAMPLE 5

Bags were prepared as in Example 4 above, but containing 60 g of a carbonate/calcite powder containing percarbonate. The bags were stored at 20° C./90% RH together with control bags made of untreated Manila hemp with viscose wet strength agent, provided with a coating of polyvinyl acetate on the edges only, for heat sealing purposes. The bags were examined at weekly intervals to determine whether the coatings had conferred resistance to degradation on the bag material. The results were as follows:

| Weight of coating (g/m$^2$) | Time taken to degrade |
|---|---|
| 0 (Control) | 1 week |
| 19 | 3 weeks |
| 22 | 2 weeks |
| 37 | 3 weeks |
| 40 | 4 weeks |

These results show that with this particular coating material a coating weight of not less than about 19 g/m$^2$ gives improved stability against degradation.

EXAMPLE 6

Example 5 was repeated with various bag materials and coating materials. Bag material degradation was assessed from the breaking strengths of 1 cm wide strips cut from the bags after storage. The results were:

| Bag material | Coating material | Coating weight | Storage time | Breaking strength |
|---|---|---|---|---|
| Sausage casing (19 g/m$^2$) | Clay* | 0 g/m$^2$ | 11 days | 1041 g |
| | | 29 g/m$^2$ | | 1189 g |
| | | 31 g/m$^2$ | | 1436 g |
| | | 37 g/m$^2$ | | 1630 g |
| Sausage casing (20 g/m$^2$) | Silicone | 0 g/m$^2$ | 21 days | NIL |
| | | 4 g/m$^2$ | | 359 g |
| Tea bag paper (27 g/m$^2$) | | 0 g/m$^2$ | | 37 g |
| | | 5 g/m$^2$ | | 251 g |

*"Dinkie-A" - Registered Trade Mark.

We claim:

1. In a detergent product comprising a particulate detergent composition contained within a closed water-insoluble water-permeable bag formed of sheet material, the improvement which comprises the provision of a layer of water-soluble or water-dispersible material between said particulate detergent composition and said sheet material in an amount effective to protect the bag material from the detergent composition and substantially to prevent dusting-out of the detergent composition through the sheet material when in a dry state.

2. A detergent product according to claim 1, wherein the bag is formed of paper, woven, knitted or non-woven fabric or plastics sheet material.

3. A detergent product according to claim 1, wherein the bag is formed of a material selected from the group consisting of polyamide, polyester, polyacrylic, cellulose acetate, polyethylene, polypropylene, polyvinyl chloride, polyvinylidene chloride and cellulosic fibres and mixtures thereof.

4. A detergent product according to claim 1, wherein the protective layer is a continuous layer of water-soluble material.

5. A detergent product according to claim 4, wherein the continuous layer of water-soluble material is laminated to the sheet material.

6. A detergent product according to claim 4, wherein the continuous layer is in the form of a water-soluble bag inside the water-insoluble bag.

7. A detergent product according to claim 1, wherein the protective layer is a discontinuous layer of water-soluble material coated on or impregnated in the sheet material.

8. A detergent product according to claim 1, wherein the water-soluble material is a synthetic water-soluble polymer.

9. A detergent product according to claim 8, wherein the water-soluble material is soluble polyvinyl-alcohol or polyethylene glycol.

10. A detergent product according to claim 1, wherein the water-soluble material is selected from the group consisting of polysaccharides, alkali metal silicates, soaps and nonionic detergents.

11. A detergent product according to claim 1, wherein the water-soluble material is selected from the group consisting of gelatine, salts or esters of alginic acid, salts and esters of methyl cellulose, carboxymethyl cellulose and water-soluble cationic fabric softeners.

12. A detergent product according to claim 1, wherein the water-dispersible material is a silicone, a fatty acid, a water-insoluble cationic fabric softener, wax or clay.

13. A detergent product according to claim 1, wherein the thickness of the layer of water-soluble material is between about 15 g/m$^2$ and about 45 g/m$^2$.

14. A detergent product according to claim 13, wherein the thickness of the layer of water-soluble material is about 30 g/m$^2$.

15. A detergent product according to claim 7, wherein the particle size distribution of the detergent composition, the pore size distribution of the sheet material and the thickness of the water-soluble material layer are such in relation to each other that less than about 5% of the detergent composition particles can pass through the pores of the sheet material.

16. A detergent product according to claim 7, wherein the particle size distribution of the detergent composition, the pore size distribution of the sheet material and the thickness of the water-soluble material layer are such in relation to each other that less than about 1% of the detergent composition particles can pass through the pores of the sheet material.

17. A detergent product according to claim 1, wherein the detergent composition is selected from the group consisting of fully formulated detergent compositions, bleaches, bleach precursors, fabric softeners, starch, perfumes, anti-bacterial agents, anti-static agents, whitening agents, blueing agents, stain removing agents and mixtures thereof.

* * * * *